US007507163B2

(12) United States Patent
Haut

(10) Patent No.: US 7,507,163 B2
(45) Date of Patent: Mar. 24, 2009

(54) FRAME ASSEMBLY FOR A CHILD SWING

(75) Inventor: Robert E. Haut, West Chester, PA (US)

(73) Assignee: Wonderland Nurserygoods Co., Ltd. (TW)

( * ) Notice: Subject to any disclaimer, the term of this patent is extended or adjusted under 35 U.S.C. 154(b) by 308 days.

(21) Appl. No.: 11/283,449

(22) Filed: Nov. 18, 2005

(65) Prior Publication Data

US 2006/0128485 A1 Jun. 15, 2006

Related U.S. Application Data

(60) Provisional application No. 60/631,462, filed on Nov. 29, 2004.

(51) Int. Cl.
*A63G 9/12* (2006.01)

(52) U.S. Cl. ..... 472/118; 472/119

(58) Field of Classification Search ..... 472/118–125; 297/273–275; 5/108–109
See application file for complete search history.

(56) References Cited

U.S. PATENT DOCUMENTS

| | | | | |
|---|---|---|---|---|
| 4,822,033 | A | 4/1989 | Kohus | 272/86 |
| D345,777 | S | 4/1994 | Pinch | D21/246 |
| D368,816 | S | 4/1996 | Mitchell | D6/500 |
| 5,525,113 | A | 6/1996 | Mitchell | 472/119 |
| 5,791,999 | A | 8/1998 | Lauro | 472/118 |
| 5,803,818 | A * | 9/1998 | Tseng | 472/118 |
| 6,010,410 | A | 1/2000 | Lauro | 472/118 |
| 6,251,023 | B1 | 6/2001 | Lauro | 472/118 |
| 6,319,138 | B1 | 11/2001 | Fair | 472/119 |
| 6,500,072 | B1 * | 12/2002 | Myers et al. | 472/119 |

* cited by examiner

*Primary Examiner*—Kien Nguyen
(74) *Attorney, Agent, or Firm*—Miller Law Group, PLLC

(57) ABSTRACT

A frame apparatus for a child's swing includes a pair of curved rear legs extending upwardly and forwardly to terminate in a pair of transversely spaced hanger housings that are positioned in a cantilevered manner from a support provided by a corresponding pair of curved front legs that extend upwardly and rearwardly to connect to mounting housings supported at a mid-point on the rear legs. The frame apparatus provides an open top, open side frame configuration for unrestricted access to and viewing of the seat. The front legs and the seat hangers can be detached from the rear legs to provide a compact storage and transport configuration for the swing. One of the mounting housings contains the battery array for the electric motor powering the swinging motion of the seat to position the batteries below and remotely from the seat. The frame members are oval-shaped to increase operating strength.

20 Claims, 7 Drawing Sheets

FRAME ASSEMBLY FOR A CHILD SWING

CROSS-REFERENCE TO RELATED APPLICATIONS

This application claims priority on U.S. Provisional Patent Application Ser. No. 60/631,462, filed on Nov. 29, 2004, the entire contents of which are incorporated herein by reference.

BACKGROUND OF THE INVENTION

The present invention relates generally to a frame for an infant swing and, more particularly, to a frame that provides unrestricted access to the infant positioned on the swing seat while providing an aesthetically pleasing and efficiently operable swing apparatus.

Baby swings are used extensively by infant caregivers to soothe and to comfort the children. An infant swing consists primarily of a seat that securely holds the infant in a position elevated off the floor and a frame apparatus that supports the seat and allows the seat to move in a reciprocal manner, typically in a forward and rearward direction though some infant seats provide a side to side swinging motion.

The first infant swings consisted of a seat suspended from a frame that was formed with a support structure that extended over top of the infant and was supported by transversely opposed support legs that hold the overhead support structure in the elevated position. This overhead support structure restricted access to the child positioned in the seat as the support structure presented a physical barrier directly above the child. Such an infant swing can be seen in U.S. Design Pat. No. D345,777, issued on Apr. 4, 1994, to Daniel Pinch, et al. Not only is the overhead support structure a barrier to accessing the child in the swing from above the child, but the support structure also presented a barrier to viewing the infant.

As a solution to the barrier presented by the overhead support structure, the "open top" infant swing was developed. As can be seen in U.S. Pat. No. 4,822,033, issued to Louis Kohus and James Mariol on Apr. 18, 1989, the overhead structural support has been eliminated to provide an open access to the child in the seat from above. However, the child can be capable of grasping either of the transversely opposing support legs, particularly as the child is swinging back and forth between the support legs. Contact between the swinging child and one of the support legs can result in injury to the child. Furthermore, the child can potentially grab one of the support legs and pull his or herself forwardly to become dislodged from the seat, particularly if the child has not been properly secured within the seat by a safety harness.

The aforementioned open top infant swing evolved in a manner to eliminate the frame structure, i.e. the support legs, positioned forwardly of the swinging seat to provide an "open side" swing frame configuration for an infant swing. Such an open side infant swing can be found in the aforementioned U.S. Pat. No. 4,822,033, issued to Kohus and Mariol on Apr. 18, 1989. In the Kohus and Mariol patent, the infant swing is provided with both an open top and an open side structural configuration to provide the capability of viewing and accessing the child within the seat from substantially any position forwardly of the seat.

The swinging motion of most baby swings commercially available is similar to that of a pendulum that pivots from above and to the sides of the seat. Although this swinging motion can be maintained by a mechanical spring-operated swing mechanism, the swinging motion in most modern infant swings is maintained, typically, by a small electric motor located adjacent one of the seat pivots supported by the frame structure. The power for this electric motor is typically an array of dry cell batteries located within the same plastic housing as the electric motor. Examples of battery operated motors to affect the swinging motion of the infant seat from a frame support can be seen in U.S. Pat. No. 5,525,113, issued to Daniel Mitchell, et al on Jun. 11, 1996, and in U.S. Pat. No. 5,833,545, issued to Daniel Pinch, et al on Nov. 10, 1998.

Although such an arrangement of placing the dry cell batteries within the same covered housing as the electric motor is convenient for the wiring of the power source to the electric motor, this arrangement has several disadvantages as well. Locating the placement of the dry cell batteries above the swing seat, exposes the child positioned within the seat to being impacted by a dropped battery when the caregiver is forced to change the batteries to replace depleted batteries with fresh ones. Dry cell batteries are manufactured with acid within the battery container. Sometimes that acid can escape from the battery which would also present an injury risk to a child positioned within the seat. The placement of the battery array within the same housing as the electric motor also increases the height of the center of gravity of the swing, thus increasing the possibility of the swing tipping over. Lastly, since the spatial requirements of an electric motor and battery array are greater than for just the electric motor alone, the size of the housing needed to contain the electric motor and the battery array detracts from the ability to view the child.

Accordingly, it would be desirable to provide a swing frame that can provide an open top and open side configuration for improved access to physically reach the child, as well as to improve visibility of the child while seated within the infant seat.

SUMMARY OF THE INVENTION

It is an object of this invention to provide a frame for an infant swing that overcomes the aforementioned disadvantages of the prior art.

It is another object of this invention that the swing frame apparatus provides a substantially unrestricted view of a child seated within the seat of the infant swing from positions forwardly of the infant swing.

It is a feature of this invention that the swing frame apparatus provides a substantially unrestricted physical access to a child seated within the seat of an infant swing from above and forwardly of the seat.

It is an advantage of this invention that the swing frame provides an open top and open side configuration for an infant swing.

It is still another object of this invention to provide a frame apparatus for an infant seat in which the front legs are joined with curved rear legs at a mid-portion thereof to permit said rear legs to project upwardly and forwardly therefrom.

It is another feature of this invention that the curved rear legs terminate at hanger housings from which the infant seat can be suspended.

It is another advantage of this invention that the hanger housings are supported in a cantilevered manner from the support provided by the joinder of the front legs with the rear legs at a mid-portion of the rear legs.

It is still another feature of this invention that the front legs can be detached from the rear legs to permit a compact storage of the swing frame apparatus with the seat structure removed from the frame apparatus.

It is still another advantage of this invention that the joinder of the front legs with the mid-portion of the rear legs is accomplished through a mounting housing supported on each rear leg for the detachable connection of a corresponding front leg.

It is yet another feature of this invention that the front leg is connected to the mounting housing through a quick disconnect mechanism.

It is still another object of this invention to utilize the mounting housing located below the motor housing to support the array of dry cell batteries to provide a power source for the electric motor providing the swinging motion for the infant seat.

It is a further feature of this invention that the dry cell battery array is located below the level of a child seated within the infant seat.

It is a further advantage of this invention that the location and the height of the dry cell battery array do not expose a child located within the swing seat to danger from acid leaking from the batteries located in the array.

It is still a further advantage of this invention that the location and the height of the dry cell battery array providing power to the electric swing motor do not expose a child within the swing seat to danger from a battery falling from the storage compartment housing the dry cell battery array.

It is still a further feature of this invention that the housing encompassing the electric motor for an infant swing can be formed in a smaller configuration by removing the dry cell battery array into a mounting housing located at a remote location with respect to the housing for the electric motor.

It is still a further advantage of this invention that the smaller housing for the electric motor on a child's swing enhances the ability to view the child in the swing seat.

It is yet another object of this invention to provide a structural component for an infant swing frame that is formed in a non-circular cross-section with a cross-sectional dimension that is greater in an axis parallel to the direction of movement of a swinging infant seat than in an axis perpendicular to the direction of movement.

It is still another feature of this invention that the cross-sectional configuration of the swing frame member is in an oval shape.

It is still another advantage of this invention that the swing frame having oval-shaped frame members is stronger in resisting the swinging movement of the infant seat than a swing frame formed with frame members having a circular cross-sectional shape.

It is yet another feature of this invention to provide a frame apparatus for a child's swing that is aesthetically pleasing while establishing an open top and open side configuration for access to and viewing of the swing seat.

It is still another feature of this invention that the swing frame apparatus utilizes a pair of transversely spaced curved rear legs that are oriented in an upwardly and forwardly reaching configuration with corresponding curved front legs that are oriented upwardly and rearwardly to intersect the rear legs at mounting housings to permit connection of the front legs to the rear legs at a mid-portion thereof.

It is another feature of this invention that the opposing front legs are joined at the lowermost forward aspects thereof by a molded front cross brace.

It is still another object of this invention to provide a frame apparatus for a child's swing which is durable in construction, inexpensive of manufacture, carefree of maintenance, facile in assemblage, and simple and effective in use.

These and other objects, features and advantages are accomplished according to the instant invention by providing a frame apparatus for a child's swing in which a pair of curved rear legs extend upwardly and forwardly to terminate in a pair of transversely spaced hanger housings that are positioned in a cantilevered manner from a support provided by a corresponding pair of curved front legs that extend upwardly and rearwardly to connect to mounting housings supported at a mid-point on the rear legs. The frame apparatus provides an open top, open side frame configuration for unrestricted access to and viewing of the seat. The front legs and the seat hangers can be detached from the rear legs to provide a compact storage and transport configuration for the swing. One of the mounting housings contains the battery array for the electric motor powering the swinging motion of the seat to position the batteries below and remotely from the seat. The frame members are oval-shaped to increase operating strength.

BRIEF DESCRIPTION OF THE DRAWINGS

The advantages of this invention will be apparent upon consideration of the following detailed disclosure of the invention, especially when taken in conjunction with the accompanying drawings wherein.

DETAILED DESCRIPTION OF THE PREFERRED EMBODIMENT

Figure 6:
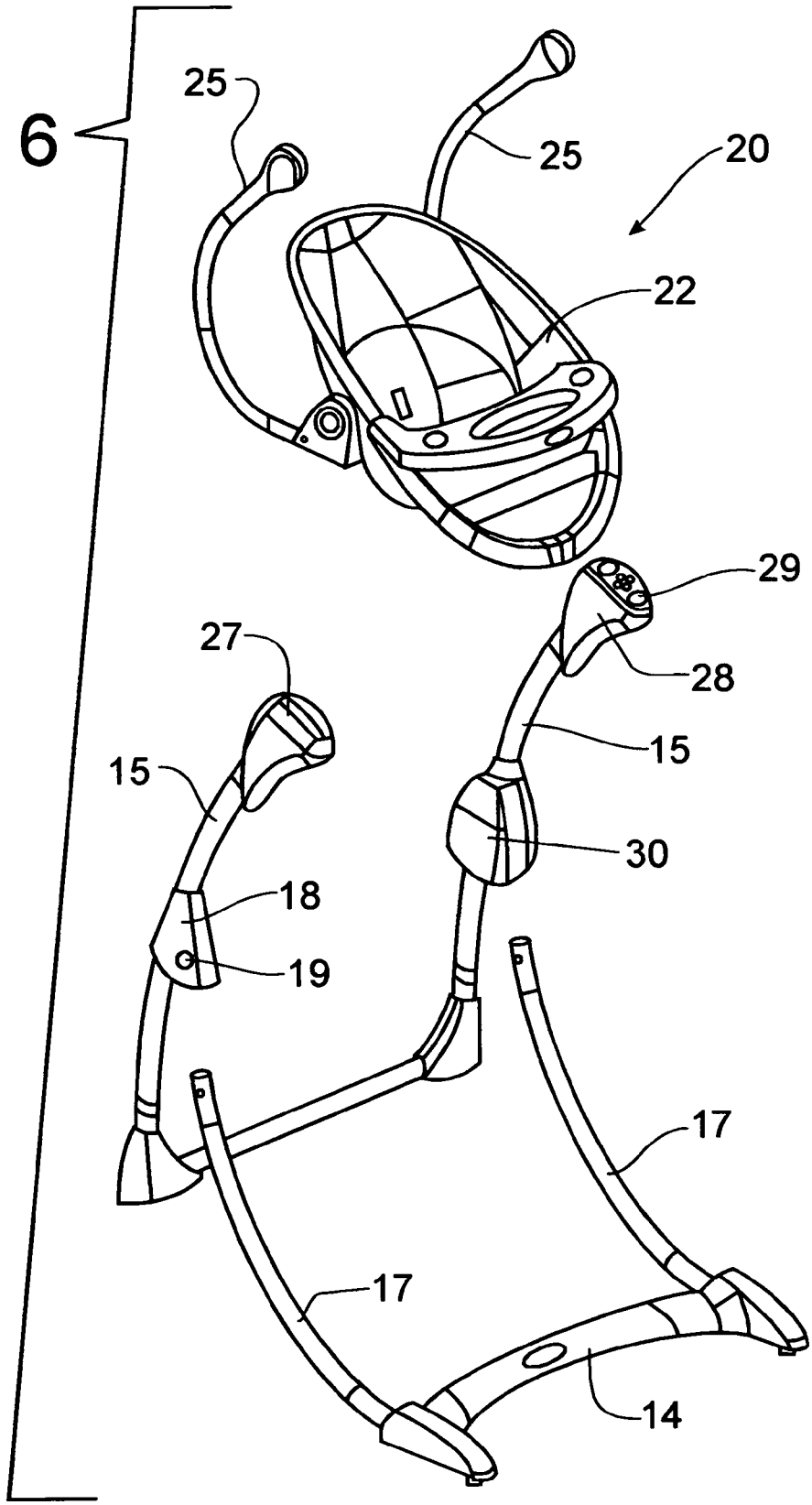
FIG. 6 is an exploded view of the major components of the infant swing disassembled to convert the infant swing into a more compact transport or storage configuration.
Figure 7:
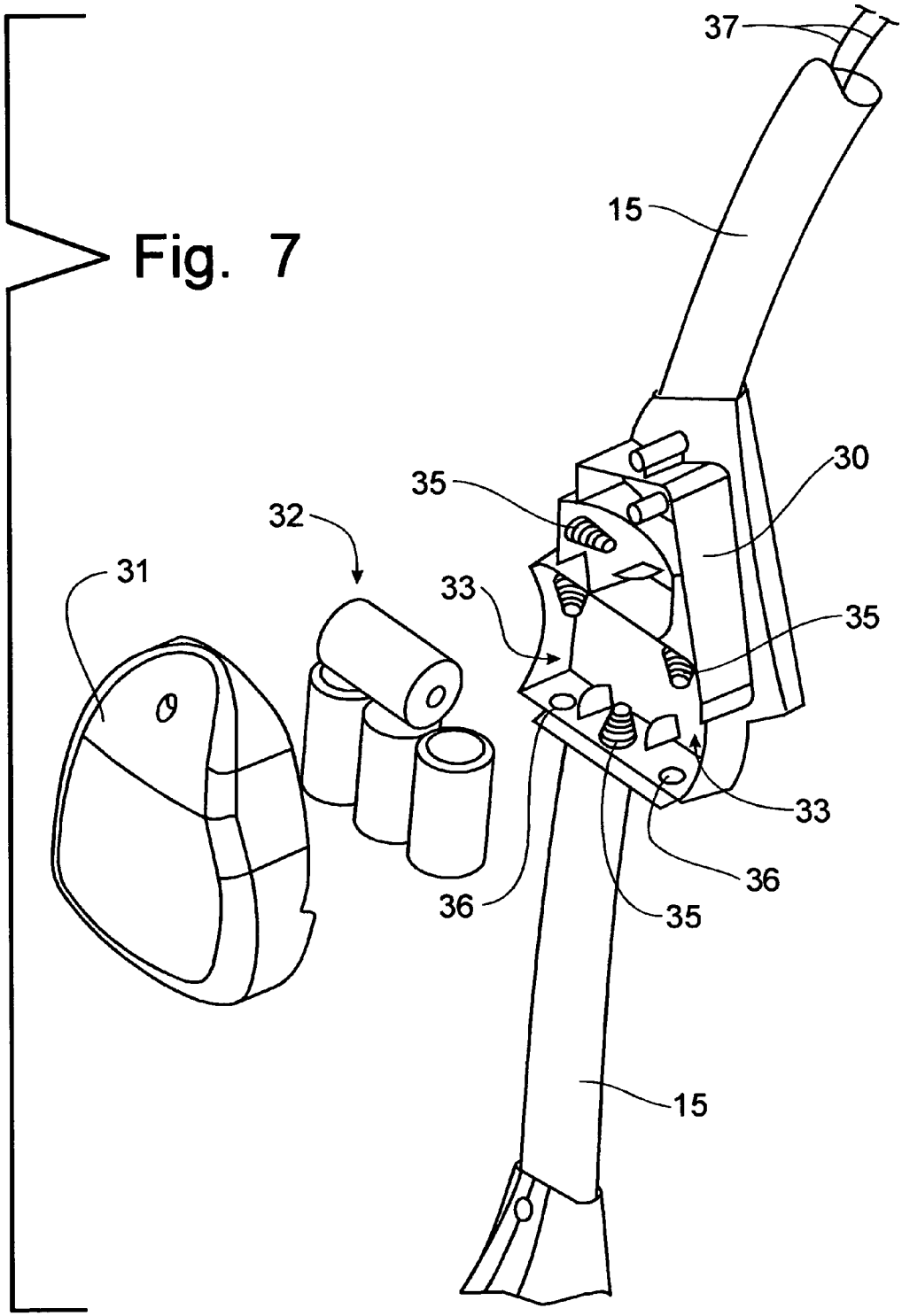
FIG. 7 is an enlarged exploded view of the battery case formed with one of the mounting housings at the junction of the corresponding front and rear legs of the frame apparatus.

Referring now to the drawings, an infant swing having a frame apparatus incorporating the principles of the instant invention can best be seen. The infant swing 10, as can best be seen in FIG. 6, includes as the major components thereof a frame assembly 12, including a pair of transversely spaced rear legs 15 and a corresponding pair of front legs 17, and a seat assembly 20 suspended from the frame assembly 12 for a fore-and-aft swinging movement. The seat assembly 20 is formed of a molded seat member 22 and a pair of transversely spaced hangers 25 that are connected to corresponding hanger housings 27, 28 positioned at the cantilevered ends of the rear legs 15, as will be described in greater detail below.

Referring now to FIGS. 1-6, the frame assembly 12 is formed with a pair of transversely opposing rear legs 15 that extend upwardly and forwardly front a rearward support position with a curvature thereof being concave facing downwardly and forwardly. The rear legs 15 terminate at upper hanger housings 27, 28 at the elevated distal ends thereof. One of the hanger housings 28 is formed to encompass an electric motor 29 that is operable to move the seat assembly 20 in a reciprocal manner in a fore-and-aft direction, as will be described in greater detail below. The curvature of the rear legs 15 provide an aesthetically pleasing shape that positions the hanger housings 27, 28 at an elevated, cantilevered position with no structure immediately below the hanger housings 27, 28.

A corresponding pair of curved front legs 17 is positioned forwardly of the rear legs 15 in fore-and-aft alignment therewith to extend rearwardly and upwardly from a front support position to intersect with the corresponding rear legs 17 at a central point thereof. Each of the rear legs 15 has mounted thereon at the central point thereof a mounting housing 18, 30 for the connection of the corresponding front leg 17 by a quick connect mechanism 19 that enables the front legs 17 to be detachably connected to the rear legs 17 and removed therefrom to convert the swing 10 into a storage configuration without the use of tools, such as a screwdriver or a wrench. The curvature of the front legs 17 is concave upwardly and forwardly so that the front legs 17 also do not provide any substantial structure beneath the hanger housing s 27, 28. The mating curvatures of the rear legs 15 and the front legs 17 establish an open side configuration of the frame assembly 12 with respect to access to a seat assembly 20 hanging from the hanger housings 27, 28.

The front legs 17 are interconnected by a molded front cross brace 14 that preferably has a curved configuration to correlate with the curved front and rear legs 17, 15 and provide an aesthetically pleasing appearance. Similarly, the transversely opposing rear legs 15 are also interconnected by a rear cross brace member 13 to provide a stable support for the suspended seat assembly 20 to resist the forces associated with the fore-and-aft swinging of an infant positioned in the seat assembly 20. The curvature of the molded front cross brace 14 eliminates the conventional tubular structural member that is positioned between the front legs. The rearwardly curved shape enables the caregiver to approach the seat assembly 20 for insertion or removal of the child from the seat member 22 without interfering with or tripping over the front cross brace found on conventional infant swings.

The seat assembly 20 includes a molded seat member 22 that is more particularly described in co-pending and commonly owned U.S. patent application Ser. No. 11/282,100, filed on Nov. 17, 2005, by Hartenstine et al., the contents of which are incorporated herein by reference. The seat member 22 provides a support structure in which an infant can be placed and secured within the seat member 22 by conventional safety restraints (not shown) and permitted to reciprocally swing in a fore-and-aft direction. The seat member 22 is supported from the hanger housings 27, 28 by curved hangers 25 that connect with the seat member 22 and present a concave shape in a forward direction. As a result, the curvature of the hangers 25 contributes to the structure-free configuration beneath the hanger housings 27, 28, in addition to the mating curvatures of the front and rear legs 17, 15, to establish the open side configuration for access to the seat member 22.

Figure 1:
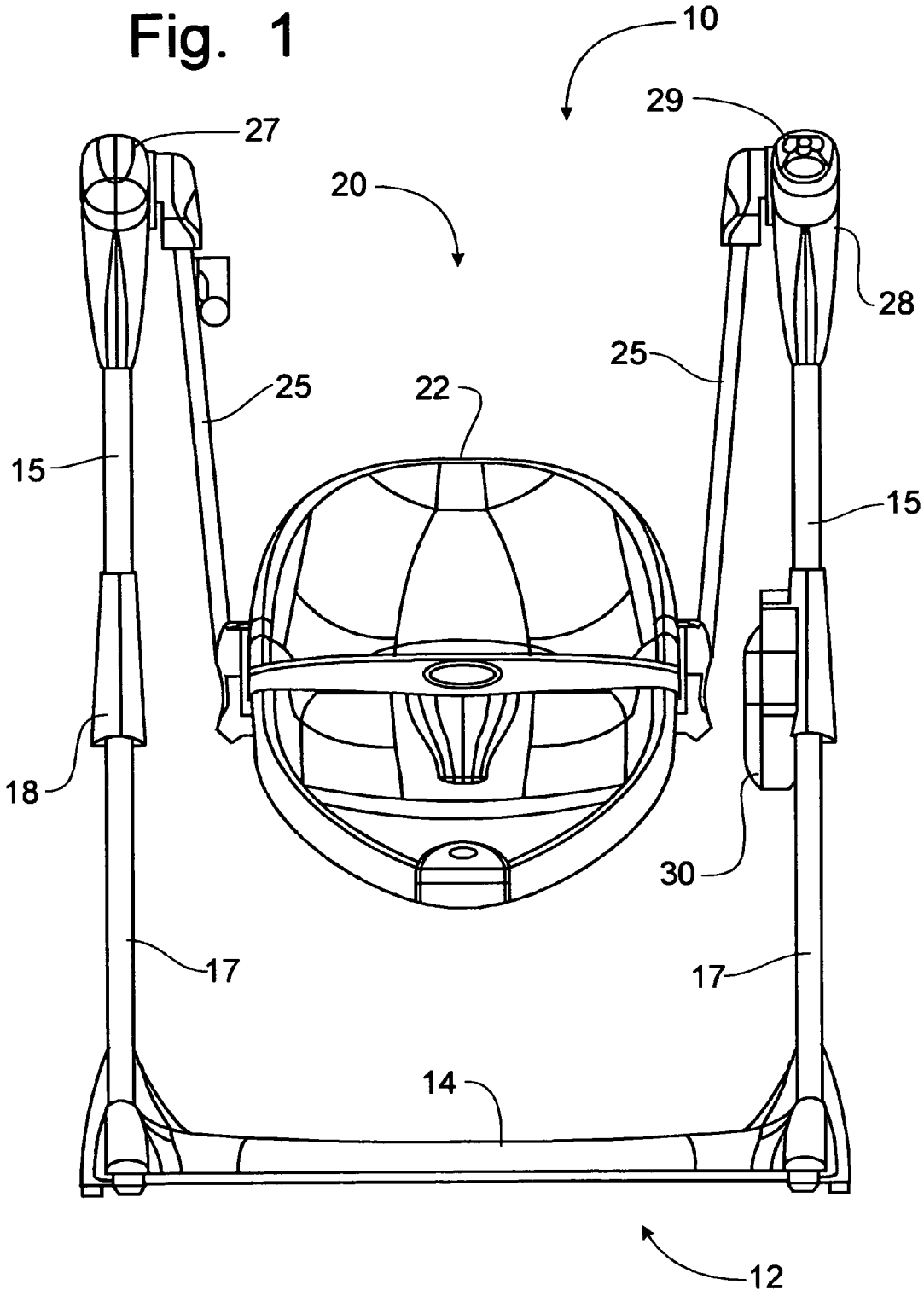
FIG. 1 is a front elevational view of an infant swing having a frame apparatus incorporating the principles of the instant invention.
Figure 2:
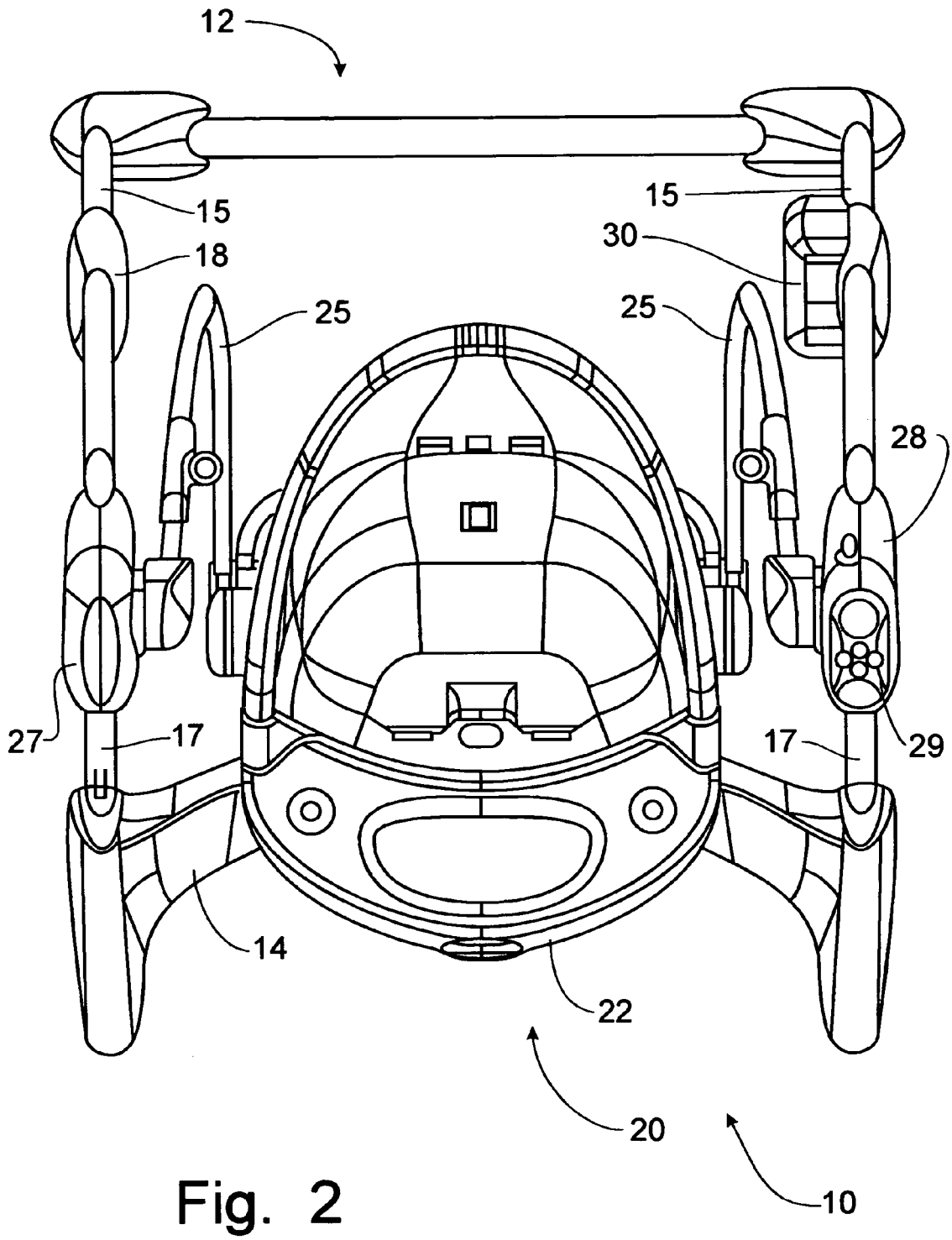
FIG. 2 is a top plan view of the infant swing depicted in FIG. 1.
Figure 3:
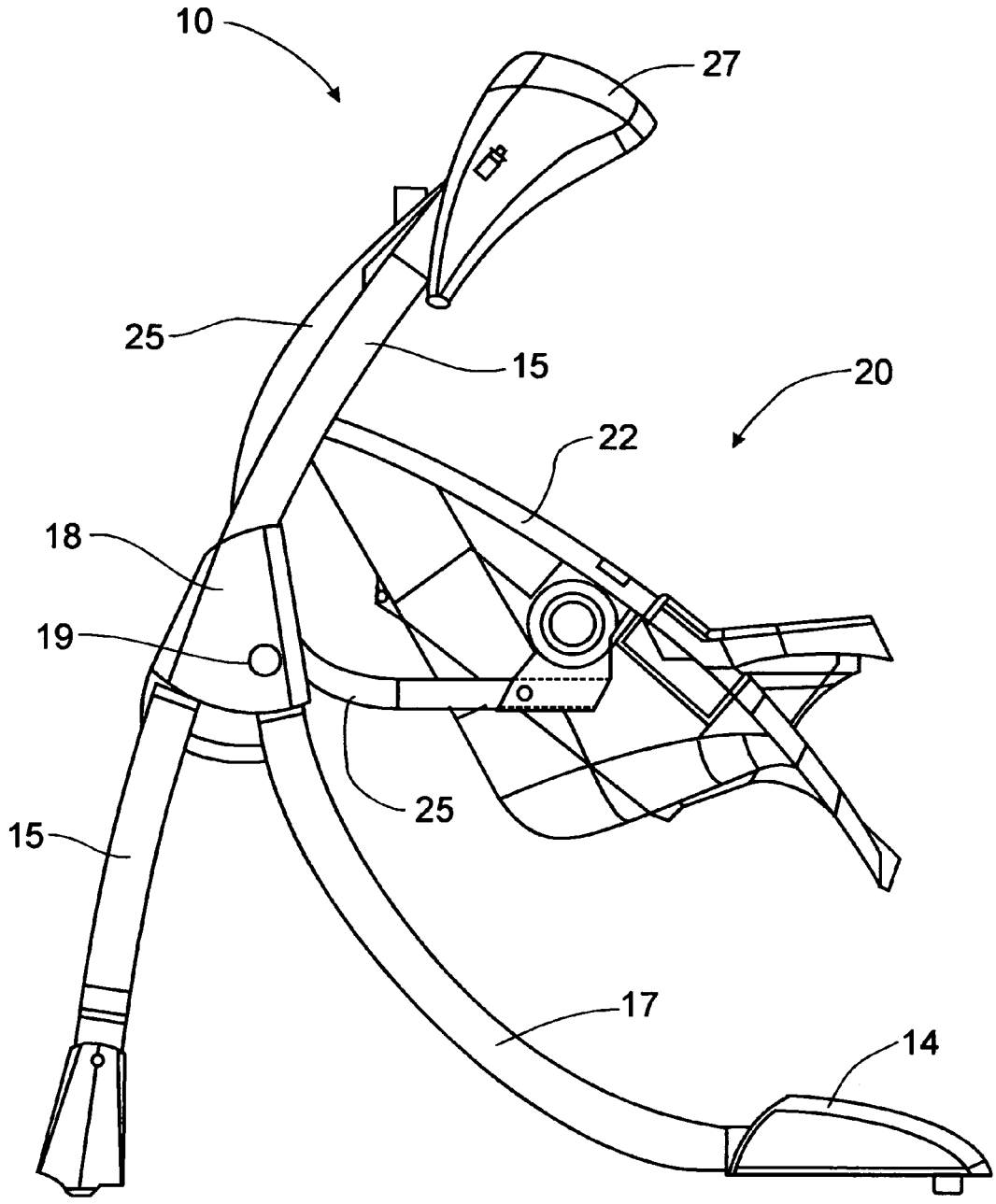
FIG. 3 is a right side elevational view of the infant swing shown in FIGS. 1 and 2.
Figure 4:
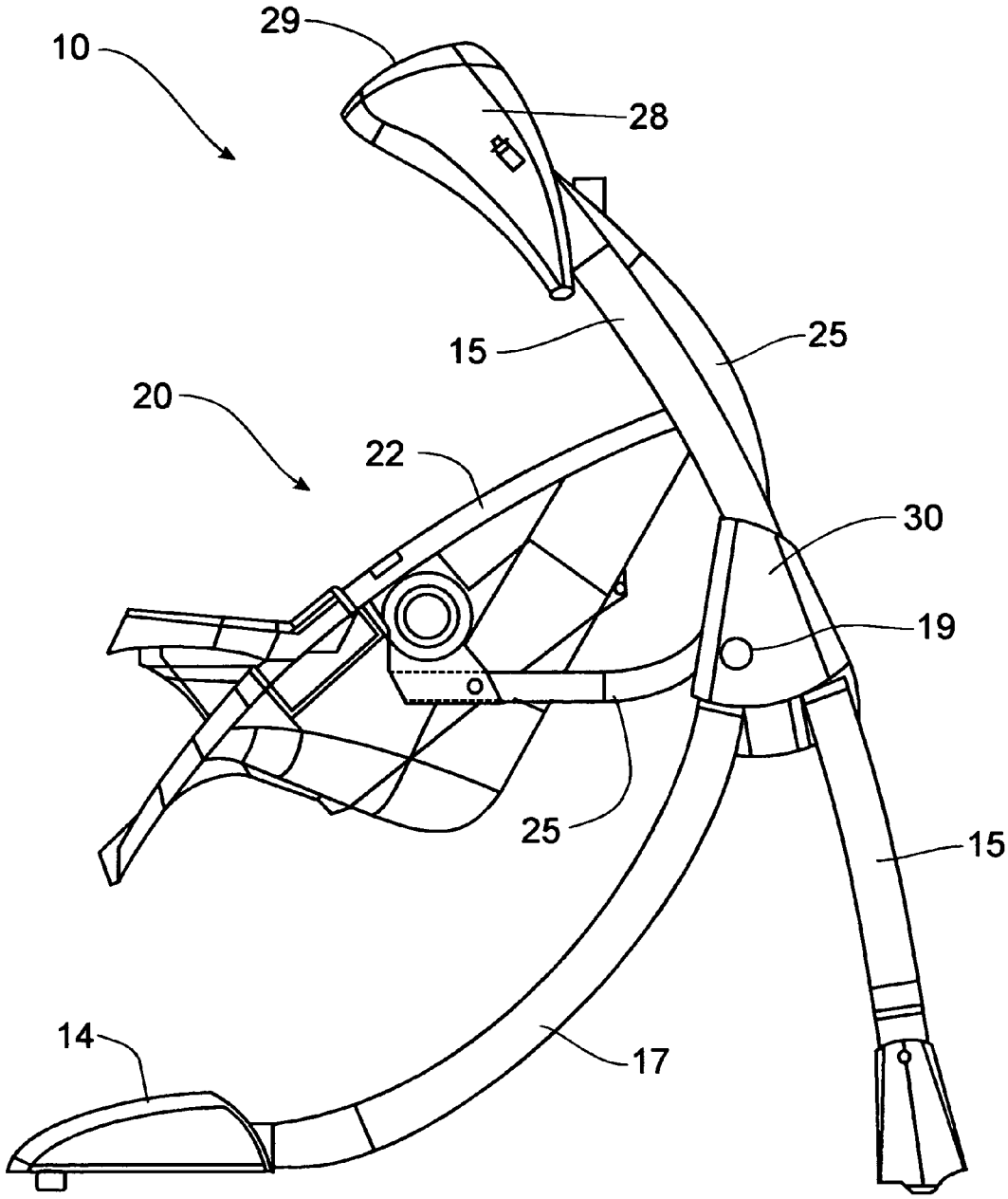
FIG. 4 is a left side elevational view of the infant swing shown in FIGS. 1 and 2.
Figure 5:
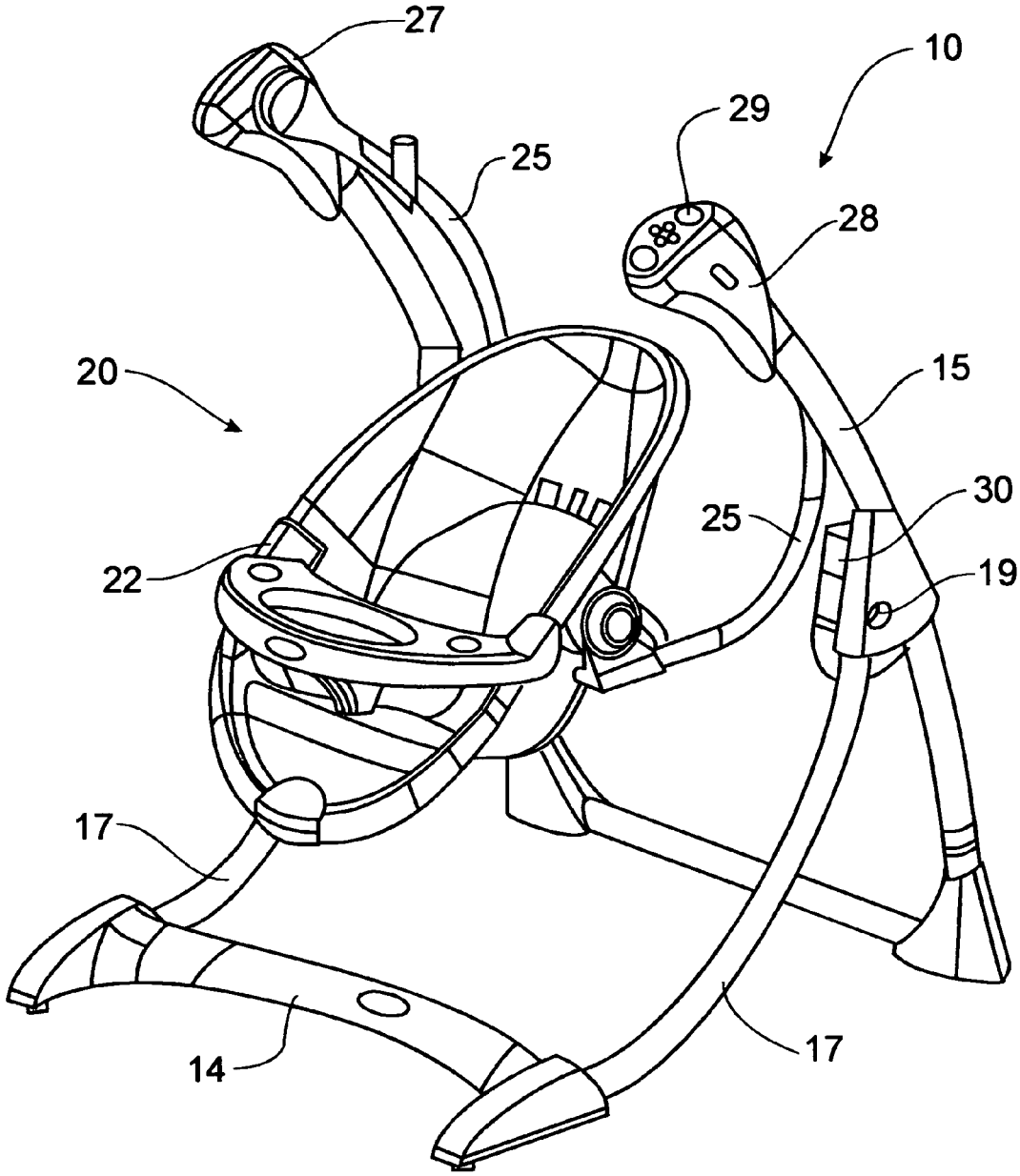
FIG. 5 is a left, front perspective view of the infant swing shown in FIGS. 1 and 2.
Figure 8:
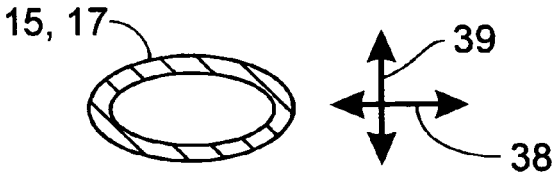
FIG. 8 is an enlarged cross-sectional view of a frame member taken along lines 8-8 of FIG. 7 to depict the oval-shaped cross-sectional configuration of the frame member.

As is best seen in FIG. 8, the structural members forming the front and rear legs 17, 15 are formed from an oval-shaped tubular member that provides a longer dimension in a direction parallel with the swinging movement of the seat assembly 12, depicted by the arrow 38, than in the direction perpendicular to the swinging movement of the seat assembly 12, represented by arrow 39. This oval-shaped cross-sectional configuration of the structural frame members provides a frame that is stronger in the resistance of the swinging motion than a frame having the same amount of material but formed in a conventional round cross-sectional configuration.

The transversely spaced hanger housings 27, 28 without any structural member interconnecting the upper distal ends of the rear legs 17 provides an open top configuration for the frame assembly 12, while the curved rear and front legs 15, 17, along with the curved hangers 25, provide an open side configuration for the frame assembly 12. Accordingly, the caregiver can access the child positioned in the seat member 22 from above, from in front, or from the side of the seat assembly 20 without interference from the frame assembly 12. These mating, curved shapes forming the frame assembly 12 establish an improved access, physically and visually, to the seat assembly 20 and any child positioned therein.

The mounting housing 30 mounted on the rear leg 17 on which the hanger housing 28 and the electric motor 29 are found is used to house an array of dry cell batteries 32 to provide power for operation of the electric motor 29. The placement of the battery array 32 at the connection of the front leg 17 with the curved rear leg 15 keeps the battery array 32 below the level of the head of the child positioned within the seat member 22, thus protecting the infant from possible injury from damaged batteries or from batteries that may be dropped onto the child seated in the seat member 22. The placement of the batteries 32 in the mounting housing 30 also enables the size of the hanger housing 28 in which the electric motor 29 resides to be smaller than if the batteries 32 were placed in the hanger housing 30 with the electric motor 29. Such geometry allows the two hanger housings 27, 28 to be sized similarly to provide an aesthetically pleasing frame structure.

The batteries 32 are mounted within individual compartments 33 having contacts 35, 36 arranged in series to provide electrical power for operating the electric motor 29 through wiring 37 that passes internally of the rear leg 15 to connect with the electric motor 29. A removable cover 31 retains the individual batteries 32 in their respective compartments 33 until replacement is required.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A frame assembly for a child swing comprising:

a pair of transversely spaced rear legs projecting upwardly and forwardly from a rear support position and terminating at respective elevated distal ends;

a pair of transversely spaced front legs extending upwardly and rearwardly from a front support position, said front legs intersecting the corresponding said rear legs at a central region of said rear legs;

a mounting housing mounted on each said rear leg at said central region to receive the corresponding said front leg for support thereof; and a hanger housing mounted on the distal end of each said rear leg for support of a seat assembly for reciprocal movement thereof in a direction of movement, each said rear leg including a lower portion extending from said mounting housing to said rear support position and an upper portion extending from said mounting housing to said hanger housing, each corresponding said front leg extending from said front support position and terminating at said mounting housing, such that said upper portion of said rear leg extends in a cantilevered manner above said front leg.

2. The frame assembly of claim 1 wherein each said rear leg is curved with a curvature that is concave facing downwardly.

3. The frame assembly of claim 2 wherein each said front leg is curved with a curvature that is concave facing upwardly.

4. The frame assembly of claim 3 wherein a drive mechanism for oscillation of said seat assembly is mounted in one of said hanger housings.

5. The frame assembly of claim 4 wherein said drive mechanism is an electric motor.

6. The frame assembly of claim 3 wherein said front legs are interconnected by a cross brace member having a curvature that is convex facing said rear support points.

7. The frame assembly of claim 3 wherein said mounting housings include quick attach connecting devices to permit the detachable connection of each said front leg.

8. The frame assembly of claim 1 wherein each of said front and rear legs include a structural member formed from tubing material, each said structural member having an oval cross-sectional configuration defining a long axis and a perpendicular short axis, said long axis being oriented parallel to said direction of movement of said seat assembly.

9. A frame apparatus for use in supporting a movable seat assembly in a fore-and-aft direction in a reciprocal manner to provide an unrestricted access to the seat assembly from positions above said seat assembly, in front of said seat assembly, and to the side of said seat assembly, comprising:

a pair of transversely spaced rear legs projecting upwardly and forwardly from rear support positions and terminating at respective elevated distal ends;

a pair of transversely spaced front legs extending upwardly and rearwardly from front support positions to terminate at distal ends intersecting the corresponding said rear legs generally at a central location on said rear legs;

a pair of mounting housings mounted respectively on each said rear leg to detachably connect the respective distal end of the corresponding said front leg for support thereof on said rear leg at said central location, said distal ends extending in a cantilever manner from the respective said mounting housings; and a hanger housing mounted on the distal end of each said rear leg for support of said seat assembly for said fore-and-aft reciprocal movement thereof, each said rear leg including a lower portion extending from said mounting housing to said rear support position and an upper portion extending from said mounting housing to said hanger housing, said upper portion and said lower portion being substantially equal, each corresponding said front leg extending from said front support position and terminating at said mounting housing, such that said upper portion of said rear leg extends above said front leg.

10. The frame apparatus of claim 9 wherein each of said front and rear legs include a structural member formed from tubing material, each said structural member having an oval cross-sectional configuration defining a long axis and a perpendicular short axis, said long axis being oriented parallel to said fore-and-aft direction of movement of said seat assembly.

11. The frame apparatus of claim 10 wherein each said front leg is formed with a curvature that is concave facing upwardly, each said rear leg being formed with a curvature that is concave facing downwardly to provide an unrestricted access to said seat assembly from a side aspect of said frame apparatus.

12. The frame apparatus of claim 11 wherein each said mounting housing includes a quick attach connecting device to permit the detachable connection of said front leg.

13. The frame apparatus of claim 12 wherein said front legs are interconnected by a molded cross brace member having a curvature that is convex facing said rear support points.

14. The frame apparatus of claim 12 wherein said frame assembly is converted from an operable position wherein said seat assembly is support in an elevated position for reciprocal movement to a transport position in which front legs have been disconnected from said mounting housings and said seat assembly has been disconnected from said hanger housings.

15. The frame apparatus of claim 14 further comprising an electric motor mounted within one of said hanger housings to operably drive said reciprocal fore-and-aft movement of said seat assembly.

16. A child swing comprising:

a pair of transversely spaced curved rear legs projecting upwardly and forwardly from rear support positions and terminating at respective elevated distal ends, said rear legs having a curvature that is concave facing downwardly;

a pair of transversely spaced curved front legs extending upwardly and rearwardly from front support positions, said front curved legs intersecting the corresponding said rear legs at a central region of said rear legs and having a curvature that is concave facing upwardly;

a mounting housing mounted on each said rear leg at said central region to detachably receive the corresponding said front leg for support thereof such that said distal ends of said rear legs are cantilevered from said mounting housing and extend said front legs;

a hanger housing mounted on said distal end of each said rear leg for support of a seat assembly for reciprocal movement thereof in a direction of movement, each said rear leg including a lower portion extending from said mounting housing to said rear support position and an upper portion extending from said mounting housing to said hanger housing, each corresponding said front leg extending from said front support position and terminating at said mounting housing; and a seat assembly including a seat member and a pair of opposing hangers interconnecting said seat member and respective said hanger housings, said opposing curvature of said front and rear legs providing an unrestricted access to said seat assembly from the side of said seat assembly, said cantilevered distal ends of said rear legs providing an unrestricted access to said seat assembly from above said seat assembly.

17. The swing of claim 16 wherein each of said front and rear legs include a structural member formed from tubing material, each said structural member having an oval cross-sectional configuration defining a long axis and a perpendicular short axis, said long axis being oriented parallel to said fore-and-aft direction of movement of said seat assembly.

18. The swing of claim 16 wherein each said mounting housing includes a quick attach connecting device to permit the detachable connection of said front leg.

19. The swing of claim 18 wherein said child swing is convertible from an operable position, wherein said seat assembly is support in an elevated position for reciprocal movement, to a transport position in which front legs have been disconnected from said mounting housings and said hangers have been disconnected from said hanger housings.

20. The swing of claim 16 wherein said front legs are interconnected by a molded cross brace member having a curvature that is convex facing said rear support positions.

* * * * *